US008667817B2

(12) United States Patent
Smith et al.

(10) Patent No.: US 8,667,817 B2
(45) Date of Patent: Mar. 11, 2014

(54) OZONE LAUNDRY SYSTEM AND ITS METHOD OF USE WITH CONTINUOUS BATCH AND TUNNEL WASHERS

(75) Inventors: Charles E. Smith, Merritt Island, FL (US); Thomas R. Allen, Cleveland, OH (US)

(73) Assignee: Guardian Ignition Interlock Manufacturing, Inc., Cocoa, FL (US)

( * ) Notice: Subject to any disclaimer, the term of this patent is extended or adjusted under 35 U.S.C. 154(b) by 772 days.

(21) Appl. No.: 12/797,600

(22) Filed: Jun. 9, 2010

(65) Prior Publication Data

US 2010/0313610 A1 Dec. 16, 2010

Related U.S. Application Data

(60) Provisional application No. 61/186,372, filed on Jun. 11, 2009.

(51) Int. Cl.

| | |
|---|---|
| ***D06F 17/12*** | (2006.01) |
| ***D06F 29/00*** | (2006.01) |
| ***D06F 35/00*** | (2006.01) |
| ***D06F 37/00*** | (2006.01) |
| ***D06F 39/00*** | (2006.01) |
| *B08B 5/00* | (2006.01) |
| *B08B 7/04* | (2006.01) |
| *C02F 1/78* | (2006.01) |
| *D06B 3/00* | (2006.01) |
| *D06B 19/00* | (2006.01) |

(52) U.S. Cl.

USPC ..... 68/5 R; 68/13 R; 68/183; 68/207; 210/760; 422/186.07; 422/186.08; 422/186.12; 422/186.15

(58) Field of Classification Search

USPC ..... 68/13 R

See application file for complete search history.

(56) References Cited

U.S. PATENT DOCUMENTS

| | | | | |
|---|---|---|---|---|
| 5,493,743 | A | 2/1996 | Schneider et al. | |
| 5,625,915 | A | 5/1997 | Radler et al. | |
| 5,939,030 | A | 8/1999 | Moxley et al. | |
| 6,006,387 | A * | 12/1999 | Cooper et al. | 8/158 |
| 6,153,151 | A | 11/2000 | Moxley et al. | |
| 6,235,206 | B1 * | 5/2001 | Chan et al. | 210/739 |
| 6,254,838 | B1 | 7/2001 | Goede | |
| 6,408,471 | B1 | 6/2002 | Teran et al. | |
| 6,418,580 | B1 | 7/2002 | Teran et al. | |
| 6,598,431 | B2 | 7/2003 | Teran et al. | |
| 2002/0027109 | A1 * | 3/2002 | Conrad et al. | 210/760 |
| 2003/0221704 | A1 * | 12/2003 | Johnson et al. | 134/2 |
| 2004/0267473 | A1 * | 12/2004 | Scheper et al. | 702/100 |

(Continued)

FOREIGN PATENT DOCUMENTS

| | | |
|---|---|---|
| CA | 2310864 | 12/2001 |
| GB | 190303371 | 0/1903 |
| WO | 2007110434 | 10/2007 |

*Primary Examiner* — Joseph L Perrin
*Assistant Examiner* — Levon J Shahinian
(74) *Attorney, Agent, or Firm* — James E. Larson

(57) ABSTRACT

An ozone laundry system and its method of use with continuous batch or tunnel washers is provided, wherein ozone can be injected into a plurality of different chambers along the continuous batch or tunnel washer and wherein the interfacing of a plurality of system controls occurs on a centralized HMI controller along with DOM and ORP monitoring. Vacuum sensors over vacuum switches are used to compensate for a slightly positive pressure at the ozone outlet, due to a long tube run with a weak vacuum.

25 Claims, 8 Drawing Sheets

(56) References Cited

U.S. PATENT DOCUMENTS

2005/0251925 A1 11/2005 Daniels
2006/0096038 A1 5/2006 Daniels et al.
2008/0047907 A1* 2/2008 Herzog ..... 210/760
2008/0092601 A1 4/2008 Konides et al.
2008/0302139 A1 12/2008 Zorn

* cited by examiner

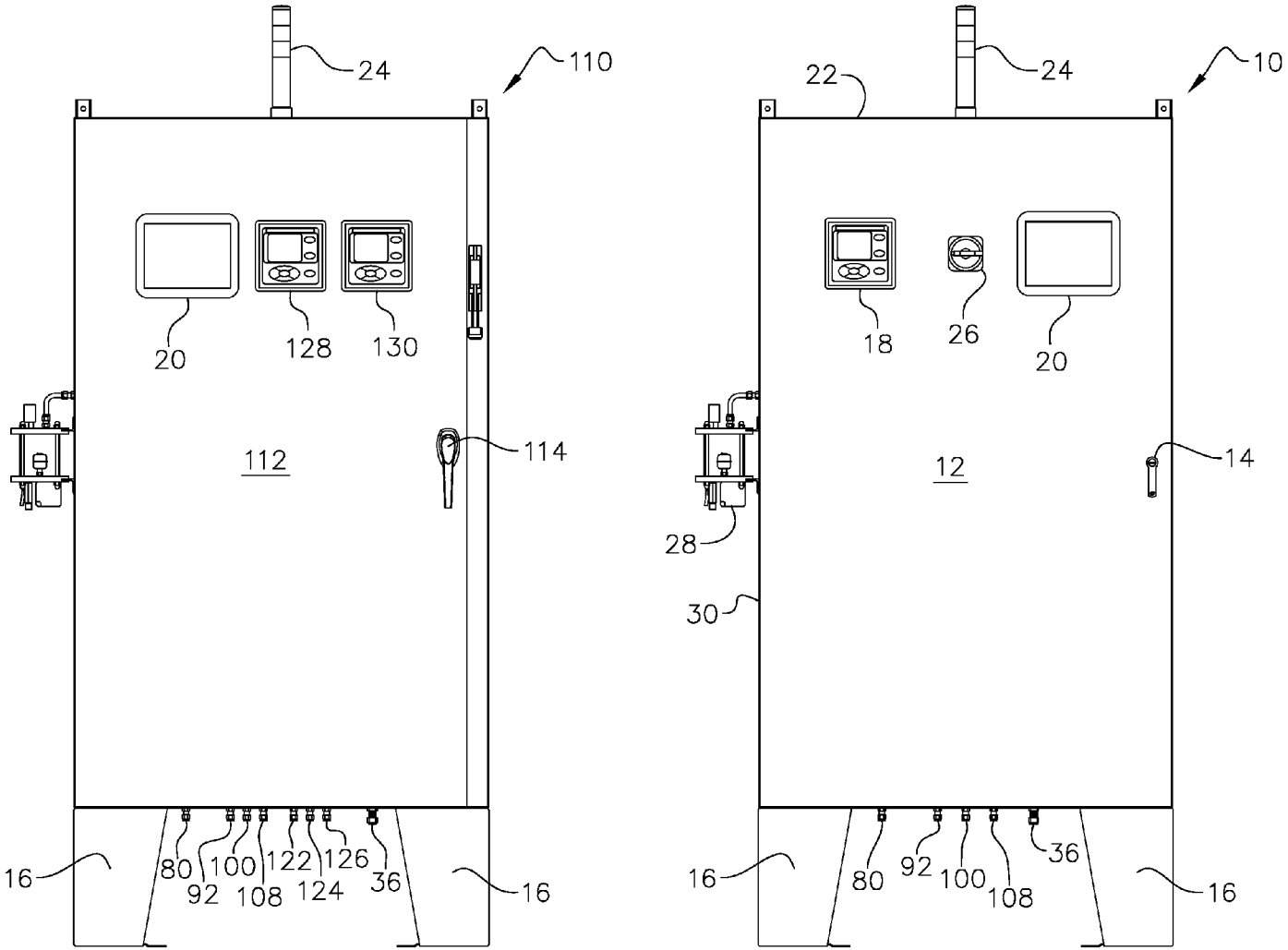
FIG. 8 NEW SHEET

OZONE LAUNDRY SYSTEM AND ITS METHOD OF USE WITH CONTINUOUS BATCH AND TUNNEL WASHERS

PRIOR APPLICATIONS

This application is a continuation-in-part of provisional patent application 61/186,372, filed on Jun. 11, 2009, still pending.

BACKGROUND OF THE INVENTION

1. Field of Invention

The present invention relates to an ozone laundry system and its method of use with continuous batch or tunnel washers. More particularly, it relates to an ozone laundry system and its method of use with continuous batch or tunnel washers wherein ozone can be injected into a plurality of different chambers along the continuous batch or tunnel washer and wherein the interfacing of a plurality of system controls occurs on a centralized HMI controller along with DOM and ORP monitoring.

2. Description of the Prior Art

Continuous Batch Washers (CBWs), also known as Tunnel Washers, are well known in the prior art. These machines are designed as industrial laundry machines for handling heavy wash loads. They are used largely by hotels, resorts, hospitals and high-volume commercial laundry service companies wherein a constant wash cycle may run as much as 24 hours a day. CBWs typically include a long metal tube that is called the "tunnel." A huge metal spiral called an "Archimedes Screw" runs down the center of the tunnel, dividing it into sections called "pockets" or "chambers." As the screw rotates, linen is forced from one end of the tunnel to the other. The screw typically employs a porous metal so that the laundry can move through the washer in one direction while water and chemicals are forced through the screw and hence the chambers in the opposed direction. As such, the linen moves through pockets of progressively cleaner water and fresher chemicals. Dirty or soiled linen is continuously placed into one end of the tunnel while clean linen is continuously moved out of the other end.

As with all industrial laundry services and machines, the use of certain chemicals that are harmful to the environment has necessitated that these machines either capture the chemicals for proper storage and disposal or that they be configured to use less chemicals. However, in certain scenarios, especially in hospitals and in hotels, the laundry being used must be washed to a certain degree of cleanliness, since many different people will use the laundered items from one wash to the next. This degree of cleanliness can usually only be achieved through the use of harsh chemicals that ensure that the soiled laundry will not only be cleaned but also whitened in the case of white linen items (i.e., bedding and bath towels).

Due to this laundry need, improvements to CBWs have been employed over the last few years wherein ozone [or trioxygen ($O_3$), a triatomic molecule, consisting of three oxygen atoms) is injected into a chamber of the CBW or tunnel washer to replace one or more of the harsh cleansers used in such laundry systems. However, the use of ozone presents its own set of problems as ozone is known to be unstable and at ground levels can be harmful to the respiratory system of animals, which of course includes the humans operating these CBW and tunnel washer systems. Therefore, great care must be taken in the control and use of ozone in any laundry system. Further, dissolved ozone in a laundry system, such as a CBW or tunnel washer, can not simply be disposed of into the sewer system. It must be properly contained, destroyed or disposed of in a manner consistent with environmental laws and regulations.

The use of ozone to disinfect laundry is actually very well known in the prior art as Great Britain Patent No. 3371 to Otto discloses a process and apparatus for disinfecting linen and other fabrics by a combined action of ozone and steam. However, it does not disclose or suggest to the use of ozone in a multi-chambered laundry system such as with a CBW or tunnel washer. Canadian Patent No. 2310864 to Erickson et al. discloses a small laundry ozonation system for home use wherein venturi-type differential pressure injectors are used for injecting ozone into the water passing from a water supply to the washing machine. This prior art invention too fails to disclose or suggest to the use of ozone in a multi-chambered laundry system such as with a CBW or tunnel washer, but it does disclose that the ozone can be entrained along a water line by injectors.

For use in a large commercial laundry system, U.S. Pat. No. 5,493,743 to Schneider et al. discloses an ozone assisted laundry wash process and apparatus, which employs a venturi-type injector for entraining ozone into the water of storage and/or contact tanks of the washing system. This prior art system also includes contact extenders, static mixers and flow restriction fittings, which all work to collect, filter and reuse the ozonated water to assist in waste water disposal problems. However, the storage and/or contact tanks make this system less than ideal for large commercial use as it is difficult to retrofit to an existing CBW or other tunnel washer and it does not allow for independent control of system chamber injection of the ozone.

U.S. Pat. No. 6,254,838 to Goede discloses an ozone generating system for laundry systems wherein a predetermined amount of ozone is dissolved in the water with a minimum of entrained ozone. This prior art system includes the use of an entrained gas separator assembly in series with re-circulating plumbing that feeds and discharges ozone enriched water. The entrained gas separator assembly allows the water with dissolved ozone to pass through while extracting the entrained ozone for subsequent use or destruction. The entrained gas separator includes a secondary tank with an off-gas valve for releasing the entrained gases including ozone. The ozone rich water from the tank's outlet is passed through a water conditioner prior to being delivered for use. In this reference, separate tank configurations are used to dissolve the entrained ozone in the water. Here again we see the inefficient use of gas separators and storage tanks that make it difficult to retrofit this system to an existing CBW or other tunnel washer and complicates tunnel washers overall by the use of storage. Also, as in the other prior art systems, this invention fails to disclose or suggest the use of system chamber specific injection of ozone as well as monitoring of each specifically injected chamber for determining critical aspects of an ozone laundry system such as dissolved ozone (DOM) and oxidation reduction potential (ORP).

US Patent Appl. No. 20080302139 to Zorn discloses an ozone laundry system wherein a tunnel washer system generates ozone (in excess) and then dissolves the ozone in water at various stages along the tunnel washer, such as with a venturi injector. In its preferred embodiment, it dissolves the ozone into three stages or compartments of the tunnel washer. However, this reference employs a storage tank, from which an ozone destruct mechanism is employed so that excess ozone can be de-gassed and subsequently destroyed. The need for this rises from the over oxygenated re-circulated water used in this system. This is a serious limitation as this invention is incapable of having independent control and monitoring of exact entrained ozone at each injection point. Therefore, the actual ozone production can not be adjusted independently by the ozone demand required to ozonate the fresh water supply at such location to a preset dissolved ozone level. Over oxygenated water can not be avoided in this prior art system and therefore it requires storage tanks, transfer pumps, cooling systems, ozone exhaust, ozone destruct systems, ozone gas-separators and other like machinery that make this prior art system inefficient, difficult to operate and very expensive to install and operate.

Oxidation reduction potential (ORP) measurement is the measuring of oxidation occurring in any chemical. In some prior art ozone laundry systems ORP measurement is employed to determine the oxidation level of the water in a tunnel washer at the beginning of the wash cycle and is used for recording purposes only. However, nowhere in the prior art are there any ozone laundry systems that measure ORP in the press pan at the end of the tunnel washer to provide a post process validation based upon a previously established ORP baseline. Further, no prior art system is using the ORP readings for diagnostic and verification purposes, of which such readings is directed to an HMI (Human Machine Interface) for reporting, alarm notification, control and reset capabilities. Further, nowhere in the prior art can you find an HMI controller on an ozone laundry system that combines sensor reporting, system alarm and system control all in a compact user interfaced touchscreen monitor that is integrated with the ozone generator system of which can be remotely controlled through the Internet or any intranet. This is a serious limitation to all exiting ozone laundry systems that needs improvement.

In view of what is known in the prior art, it can be clearly seen that vast improvements are needed in ozone laundry systems for use as retrofitted systems or to be part of a complete new installed system for CBWs and tunnel washers in the commercial arena that incorporates enhanced sensor and control capabilities that can all be controlled from a centrally located HMI controller on a cabinet that incorporates the entire ozone generator and distribution system and wherein specifically dissolved ozone can be deposited in particular chambers of the tunnel washer by entraining ozone through injectors along independent water entry points.

SUMMARY OF THE INVENTION

We have invented an improved ozone laundry system for use with continuous batch or tunnel washers, which applies ozone gas to the water as part of an ozone laundry process. Use of our novel ozone laundry system allows existing and new CBW laundries to process laundry and linens in ambient or reduced water temperatures. Our novel system saves energy for heating water, reduces actual water usage, reduces the wash and bleaching chemistry demands, reduces linen wear in the wash and drying processes, improves water extraction in press and spin extract applications, reduces natural gas used in the laundry drying and pressing processes, reduces time required to dry laundry, increases laundry operations productivity and improves worker environment to name just a few of the benefits and objects of the improved zone laundry system of the present invention.

Our novel system incorporates a self-contained (single or dual cabinet) integrated ozone system that can be added to existing, or new, CBW laundry operations without the need for adding ancillary equipment, such as storage tanks, transfer pumps, cooling systems, ozone exhaust systems, ozone destruct systems and ozone de-gas separators, to name just a few of the ancillary equipment needed by the prior art. This alone is a significant improvement over the prior art.

Our novel system adds ozone to the existing wash process of the CBW. This includes adding ozone to the traditional "fresh water" inlet streams from the city, or potable, water supply, as well as, adding ozone to the original "pumped water" transfer points on the CBW systems. The improved process of our present invention allows for ozone to be added to the CBW in a manner that sufficiently replaces the "hot water" energy supply to the wash, bleach, and rinse processes without the need to change the fundamental operational parameters of the CBW factory water flows.

Integrity of the CBW's water flow is maintained by properly sizing ozone injectors to allow original water flow GPM (gallons per minute) to be maintained, while also properly contacting (entraining) ozone gas with the water stream. Static mixers, back pressure valves, and other mass transfer devices can be used to assist in this contacting process, but are not required in the preferred embodiment.

Our novel ozone laundry system's actual ozone production on a first ozone cell is controlled by the ozone demand required to ozonate the fresh water supply to a preset dissolved ozone level with the use of a dissolved ozone sensor/controller. This control can be at one, or multiple, fresh water inlet locations on the CBW. This dissolved ozone sensor/controller reports to a centralized HMI. It should be noted that in a multi-generator system, the DOM Sensor may be used in a direct control method (also known as "PDM") or in a passive method (or "manual" method), wherein sensor readings are used to determine a constant generator output that is controlled manually or by system software. Changes and adjustments can then be made to generator output manually or with automated software calculated adjustments, from monitoring sensor readings over a programmed period of time. In a single generator system, a particular output on the single ozone cell is determined to be for the main fresh water fill on the tunnel washer. That ozone cell output, for this outlet, is then operated in the above mentioned manual method or a software adjusted method to maintain proper ozone DOM levels.

At least one residual ORP sensor is employed to monitor, report and/or control downstream ozone and oxidation levels in the wash/bleach/rinse processes in the CBW. These readings are logged by the systems controls for reporting and system fault functions on the HMI controller, accessible to the operator on the front cabinet door of the system.

At least one pH sensor is employed that can be used to monitor and report pH levels throughout the CBW wash/bleach/rinse processes. These sensors can also be used to control the chemical dosing of pH neutralizing agents in the CBW's final rinse process. These readings are also logged by the systems controls for reporting and system fault functions and are accessible on the HMI.

The ozone output of the system's at least second ozone cell (or other ozone outlets on a single cell system) is controlled by manual set-points programmed into the system HMI. There is a combination of three or more set-points that are individually set, then added together to supply the ozone cell with a total percentage of output to maintain. The total percentage is varied depending on how many output set-points are being commanded at any one time.

The present invention is linked, via dry contact relays, to the CBW for system operational verifications. The connections activate and deactivate to tell the ozone system when there should be ozone production demand on a particular part of the CBW operation (i.e., if there is a connection on one of the links, but no vacuum, ozone demand is registered by the system, whereby the system will create an alarm or notification of a system fault through the HMI). Further, in the preferred embodiment our system is connected to the Internet via an Ethernet connection that allows for remote access and control of the programming and components. However, it can also be controlled locally through direct or wireless connection (i.e., with a laptop, a tablet PC or a hand held computing device, such as a PDA or a smart-phone, no name just a few examples), or locally over an intranet. Still further, our novel ozone laundry system has alarm functions for system, environmental, and operational faults, which can be set-off by plurality of various means, including audible, visual and electronic means.

Multiple variations on our novel system design (alternate embodiments) provide for more sensors for control and data logging in different customer environments. Further, our system is expandable to operate as a water reuse system to reduce water usage in the CBW. This is achieved by capturing current rinse overflows in a storage tank for recirculation back into the CBW operation. Still further, an alternate embodiment to the present invention employs wastewater capture, filters, ozonate filters and storage and pumping processes. This cuts the water use in the CBW by as much as 70-75%, depending on how much water is needed to back flush the media filters, and how much is lost to the dryers.

The objects of the present invention as stated above, as well as many others yet to be stated, will become apparent when taking into consideration both the brief description of the drawings and detail description of the preferred embodiment both set forth below.

BRIEF DESCRIPTION OF THE DRAWINGS

The detailed description of the invention, contained herein below, may be better understood when accompanied by a brief description of the drawings, wherein.

DETAILED DESCRIPTION OF THE PREFERRED EMBODIMENT

Figure 1:
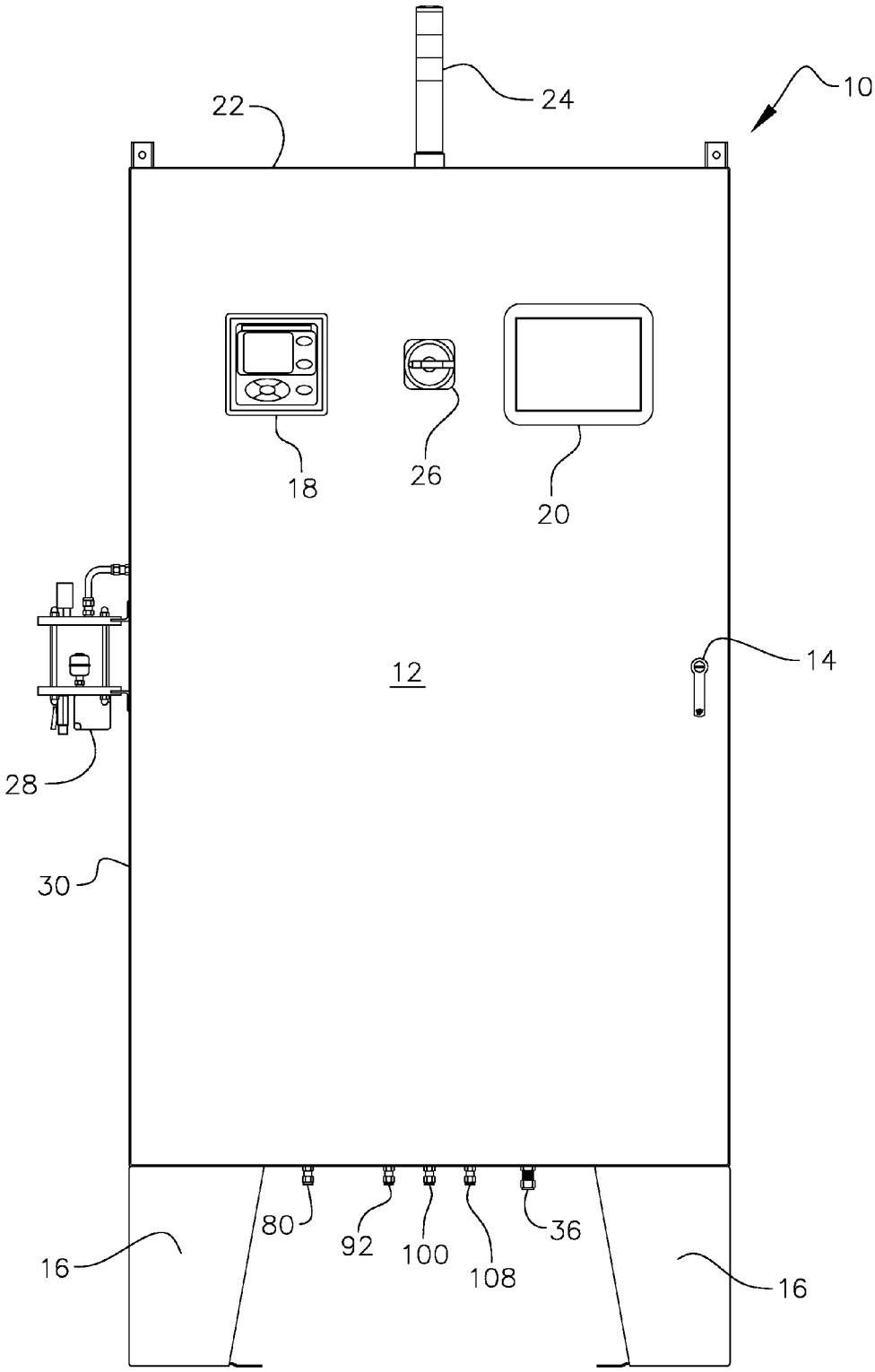
FIG. 1 is a front plan view of the ozone laundry system of the present invention.

Referring FIG. 1 shows a front plan view of an ozone laundry system 10 of the present invention. Ozone laundry system 10 is a cabinet having a hinged door 12, a handle 14 for opening door 12 and a set of support legs 16. Mounted within hinged door 12, on a front side thereof, is a dissolved ozone monitor (DOM) 18 and a human machine interface (HMI) 20.

On a top side 22 of the cabinet of system 10 is a light tree 24 for use as an indicator for status of operation, alarm and other monitoring functions. Mounted in between DOM 18 and HMI 20, but which is not limited to such location, is an emergency shut-down switch 26 for system 10.

Figure 2:
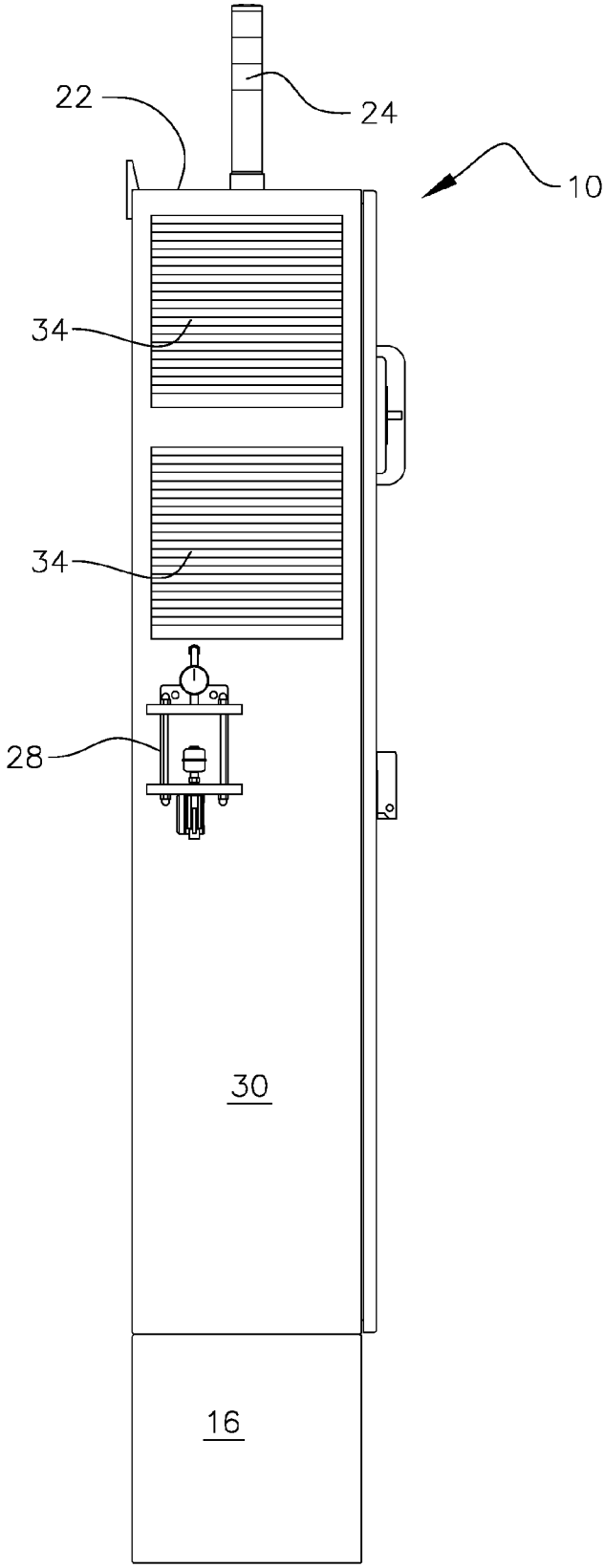
FIG. 2 is a left plan view of the ozone laundry system of the present invention as seen in FIG. 1.

Referring now to both FIGS. 1 and 2, a backflow sensor/protector device 28 is mounted along a left side 30 of the cabinet of system 10, which is constructed with a glass cylinder with steel caps on opposing ends and enclosing a float in water that upon rising to a certain level will shut down the system 10 by plugging.

Figure 3:
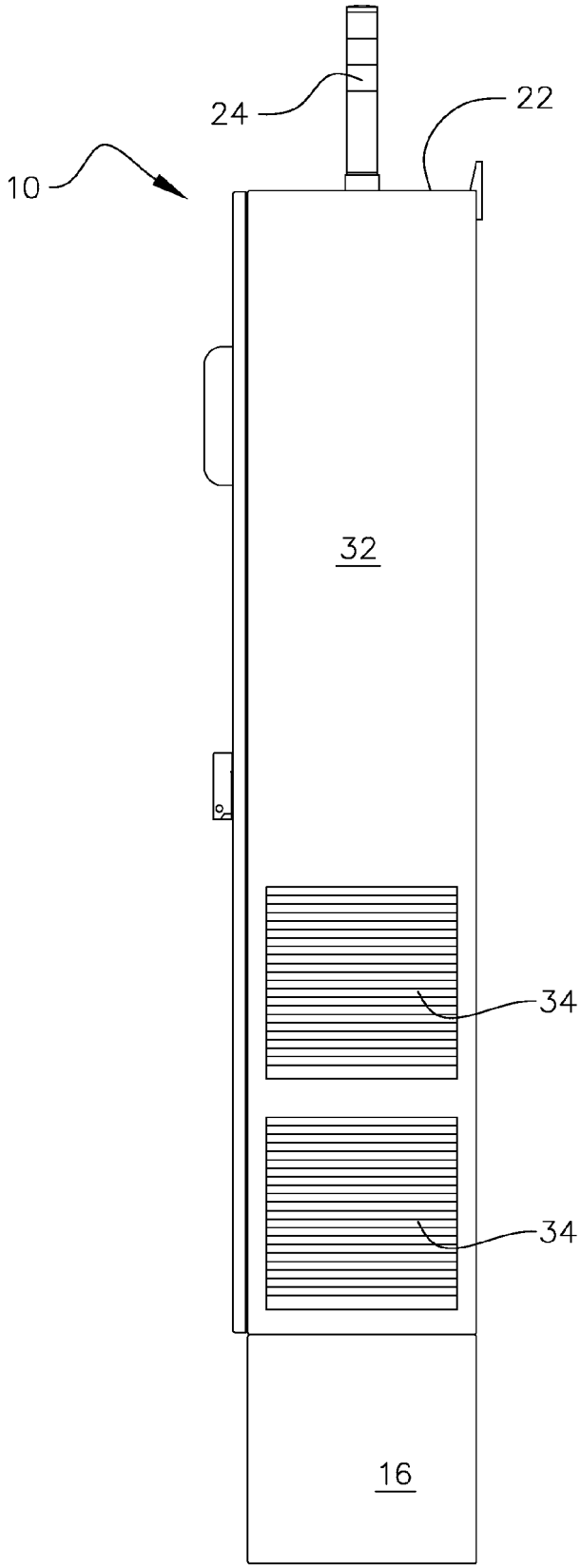
FIG. 3 is a right plan view of the ozone laundry system of the present invention as seen in FIG. 1.

Referring now to FIGS. 2 and 3, it is shown that left side 30 and a right side 32 are provided with a plurality of air vents 34. In this preferred embodiment of FIGS. 1-3, two air vents 34 are used on each of left and right side, 30 and 32, respectively. However, nothing herein limits the use of more than two air vents on each side and further nothing limits the use of additional air vents on other side of the cabinet of system 10.

Referring back to FIG. 1, DOM 18 is actually a two channel meter monitoring dissolved ozone entrained into the fresh water supply and the ORP (or, "oxidation reduction potential"), which measures any oxidation in the water and not just ozone. The novel approach in the present invention of monitoring ORP is that it occurs mid-process and as well as at the end of the process (i.e., in the press pan which is used to catch water from the system press). More particularly, the ORP is monitored in the press pan (or press reuse water line/flow) to provide a post process validation. Using a "clear water" (tap water) ORP as a baseline (established prior to installation of system 10 in any specific location), system 10 of the present invention is able to run a tunnel washer with just ozone and water to determine a relative set point for ORP at the end of the process. System 10 then permits the setting of a span above and below that relative set point for ORP values. The high and low points of that span can then be programmed for logging, reporting, or system alarm points in system 10. A "high" ORP reading, above the top span, indicates that there is likely a chemical carryover happening, such as, for example, too much chlorine migrating down the tunnel through the process. A "low" ORP, below the bottom span, indicates a lack of ozone. This could be from low ozone production, which could be cross-checked with the actual DOM on system 10 at DOM monitor 18. However, if the system production checked out, the problem would then more than likely be some kind of high ozone demand in the tunnel process that would need to be identified. Without this novel diagnostic ability many problems would be missed in a tunnel operation, and potentially affect results. Part of verifying the success of ozone in any prior art "On-Premise" laundry is the presence of ozone at the end of a wash cycle, which is noted by an operator through smell when the door of the washer is opened. However, in a tunnel system, there is a continuous process occurring and usually there is no opportunity to test the end of the tunnel to smell ozone. Therefore, the ORP validation in the press pan gives system 10 of the present invention a remote capable measurement of process success, not seen before anywhere in the prior art.

With continuing reference to FIG. 1, HMI controller 20 is a touch-screen sensitive monitor for user software interface control. HMI 20 allows for full control of all sensors and generators (to be discussed hereinafter) in one fully integrated control system. It can be also locally controlled and programmed by direct connection by way of a laptop, for example, over an intranet or remotely over the Internet.

Figure 4:
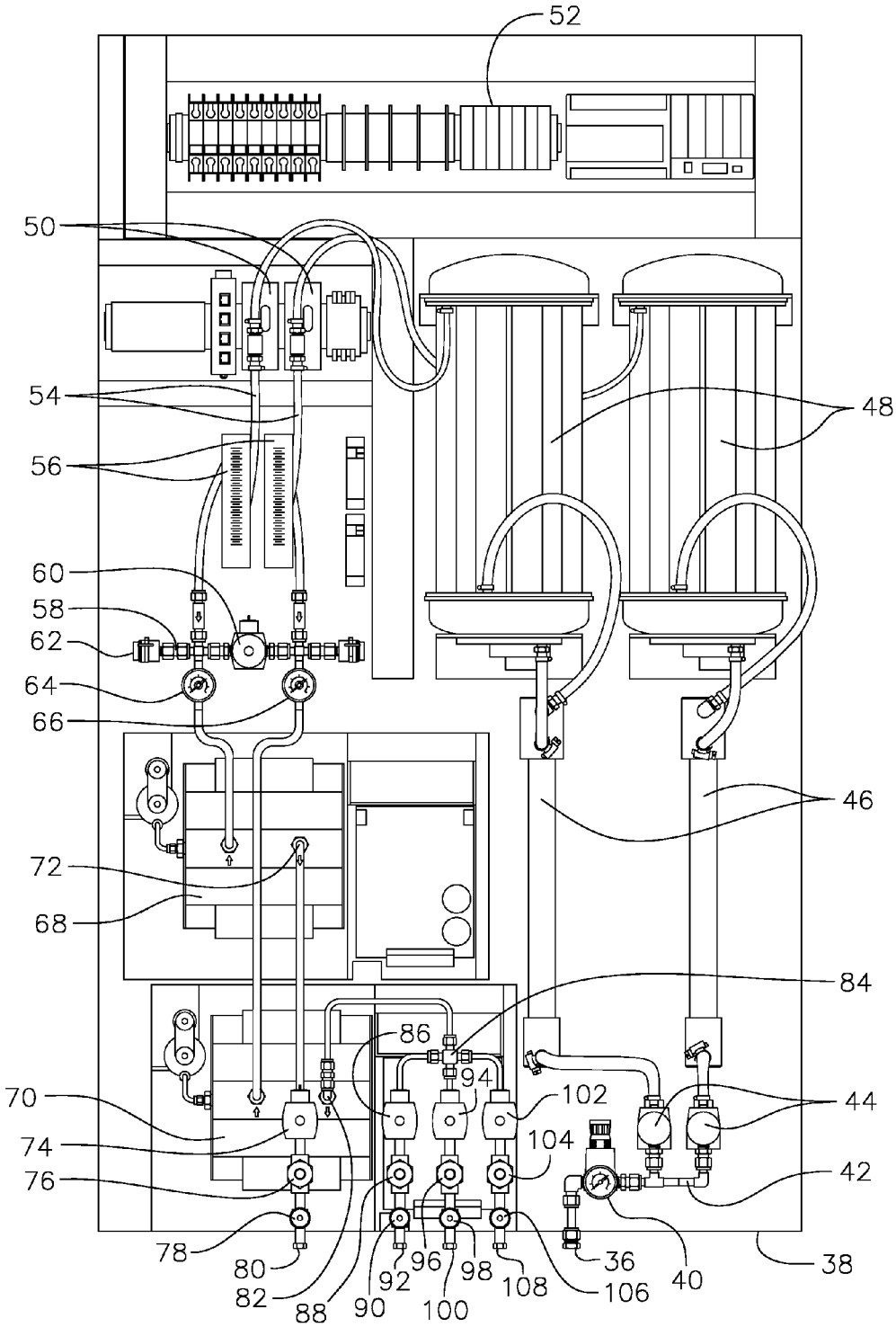
FIG. 4 is an internal view of the components that make up the ozone laundry system of the present invention as seen in FIG. 1.

Referring now to FIG. 4, the internal components of ozone laundry system 10 are shown, as if door 12 where opened by handle 14 (see FIG. 1). As shown, a first compression fitting 36 is provided along a bottom portion 38 of the cabinet of system 10 and which is used as a compressed air connection to system 10 from the plant location wherein system 10 is located. A pressure regulator 40 is mounted along an air input line 42 after first compression fitting 36. Thereafter, a pair of square solenoids 44 is connected in parallel from pressure regulator 40 and connects to a pair coalescing filters 46, having a filament material inserted therein, for providing a dry wave stream to a pair of oxygen concentrators 48. Coalescing filters 46 act as humidity removal devices. Oxygen concentrators 48 then turn the inputted air, filtered trough the coalescing filters, into 90% pure oxygen.

With continuing reference to FIG. 4, each oxygen concentrator 48 is connected to its own $O_2$ sensor/analyzer 50, which in turn is connected to a programmable logic circuit (PLC) 52 of ozone laundry system 10. $O_2$ sensor/analyzer 50 is a monitor and control device, which repots to HMI 20 through either an analog output or by a relay connector to PLC 52. After passing by each $O_2$ sensor/analyzer 50, air output lines 54 connect through a pair of flow meters 56, which each have an output that then connects to a crossover network 58. Crossover network 58 is used to redirect the concentrated oxygen from either oxygen concentrator 48 to supply the entire ozone output in the event that one of the oxygen concentrators 48 must be taken off-line for repair or replacement. This allows system 10 to continue to operate even though one of the oxygen concentrators 48 is off-line. A solenoid 60 is positioned along a center bar 62 of crossover network 58, and at opposite sides thereof, are a pair of valves 64 and 66 for regulating and controlling the flow of oxygen through crossover network 48.

With continuing reference to FIG. 4, each of the pair of valves 64 and 66 supply concentrated oxygen to a pair of ozone generators, valve 64 to first ozone generator 68 and valve 66 to second ozone generator 70. First ozone generator 68 has an output 72 that directs the generated ozone through a solenoid 74 and through mechanical needle valve 76, then through a vacuum sensor 78 and finally out through a compression fitting 80, which is a single output connected to the DOM 18.

Again, with continuing reference to FIG. 4, second ozone generator 70 has an output 82 that directs the generated ozone to a distribution junction 84 having three branches. A first branch supplies a portion of the generated ozone through a second ozone generator first solenoid 86, then through a second ozone generator first mechanical needle valve 88, thereafter through a second ozone generator first vacuum sensor 90 and finally out through a second ozone generator first compression fitting 92, which supplies generated ozone from second ozone generator 70 to a first zone of a tunnel or continuous batch washer. Further, a second branch supplies a portion of the generated ozone through a second ozone generator second solenoid 94, then through a second ozone generator second mechanical needle valve 96, thereafter through a second ozone generator second vacuum sensor 98 and finally out through a second ozone generator second compression fitting 100, which supplies generated ozone from second ozone generator 70 to a second zone of a tunnel or continuous batch washer. Still further, a third branch supplies a portion of the generated ozone through a second ozone generator third solenoid 102, then through a second ozone generator third mechanical needle valve 104, thereafter through a second ozone generator third vacuum sensor 106 and finally out through a second ozone generator third compression fitting 108, which supplies generated ozone from second ozone generator 70 to a third zone of a tunnel or continuous batch washer.

The use of the vacuum sensors in the present invention along with an analog output, on the CBW ozone systems is very unique. Several ozone laundry systems use vacuum switches for activation of the system. However, there has not been a laundry system that utilized a vacuum sensor to transmit vacuum/pressure levels to a PLC/HMI for system activation as in the present invention. The distinction is important for the CBW applications, because, for example, if a system is using MAZZEI® venturi injectors on the pumped transfer point on various tunnel configurations from multiple manufacturers, at some point, you will likely have a scenario that requires a high volume of water flow, with low flow pressure. When that occurs a simple vacuum switch would not work properly, because of the longer ozone tubing runs required on CBW applications. A MAZZEI® venturi injector may supply enough vacuum to activate a vacuum switch with no flow, but once the system begins to flow gas to the MAZZEI® venturi injector there is not enough suction to maintain the vacuum on the switch. This will cause a system, or a zone of a system, to activate and deactivate repeatedly. The present invention is able to avoid this kind of problem with variable programmed set points on each zone of the system. The sensors can read a range from ~(−10) PSI to ~(+60) PSI, allowing the system to be programmed for normal operation even if there is slightly positive pressure at the ozone outlet, due to a long tube run with a weak vacuum.

To further understand the importance of the solenoid use, in conjunction with any manual controls and the vacuum sensors of the present invention, the following should be considered. The proper control of the flow between the pressurized ozone cells and the vacuum of the injector is one of the most critical parts of any water/ozone process. As mentioned above, the CBW application has varied flow volumes and pressures, at multiple points, making it more difficult to achieve the desired balance between cell pressure and injector vacuum. It is the combination of solenoids (used to isolate flow to independent process and to protect against process water backflow), manual adjustments (used to regulate the flow of gas out of the ozone cell and to create a restriction between cell and injector) and the novel approach of using vacuum "sensors" that is a key distinction in the present invention over the prior art. The vacuum sensors include a transducer, which speaks to the PLC. These characteristics have never been employed in an ozone laundry system for attachment to a CBW heretofore.

By way of example, consider the following. Take a CBW having a Tunnel Load Weight=130 Lbs. and a Tunnel Transfer Rate=2:30 Min/Sec. Consider that the original date for this unit is a Fresh Water Flow Rate that equals 46 Gallons Per Minute (GPM) and a Water Ratio that equals 0.9 Gallons Per Pound (GPP). With the present invention, the Fresh Water Flow Rate can be reduced to 35 Gallons Per Minute (GPM) and the Water Ratio to 0.7 Gallons Per Pound (GPP). This can be in an 8 Mod CBW that injects fresh water in Mod 7 as the main fill. This is considered the main fill of the system, and it runs any time the CBW is not in "system hold." The factory standard is whatever flow rate is going into the main fill should be split 65/35 at the systems "flow splitter" at Mod 6. 65% should go back into the system at Mod 5, and the other 35% goes up to the reuse tank at the front of the CBW. The present invention continuously injects ozone in Mod 7, with, for example, a MAZZEI® venturi injector model number 1583 @~50 PSI pressure. This yields 32 GPM into Mod 7, about 6-7 GPM less than the original installation. Our system also injects fresh water into Mod 8, with a MAZZEI® venturi injector model number 1078 @~50 PSI. This yields ~15 GPM, and the fill is typically 50-60 seconds to reach level. These two fresh flows calculate out to about 35 GPM total, over the 2:30 transfers.

Mod 5 also has MAZZEI® venturi injector model number 1583 in its' water line. However, this injector is pump fed by a CBW transfer pump and only receives ~30. The actual water flow on this injector is ~25 GPM wide open, or about 78% of the water going into Mod 7. Our system closes the throttle valve before the CBW flow meter to slow down the GPM to 21 (recommended 65% of Mod 7 flow), then it further reduces the inlet pressure to the MAZZEI® venturi injector and lowers the suction capability of that injector. This in turn lowers the vacuum that can be registered at the ozone system on that zone. Therefore, the present invention can set the vacuum sensor on Mod 5 to activate at a lower vacuum point.

In this scenario, our system is able to actually see vacuums that would have activated a vacuum switch on each zone alright. But, when you take the same scenario to a longer tunnel, the flows start to change. That is because the longer the CBW, the faster they transfer, as a rule. So, the faster the water must flow to meet the same water ratio needs. For example, a longer tunnel may need to flow 39 GPM from its flow splitter using the same exact pump that the present invention we uses in a shorter tunnel scenario. That means stepping up to a MAZZEI® venturi injector model number 1584, which flows about double the 1583 with equal pressures. Only now, our system has about a 22 PSI inlet pressure, with the higher flow, yielding lower injector suction. Therefore, the −3 PSI set point, used on the vacuum sensor in shorter tunnel system, will likely be −1 PSI in a longer tunnel system. A normal vacuum switch would drop in and out that close to zero PSI, after a 30 foot tubing run.

After installation and you demonstrate cleaning, our system encourages a plant to speed up this first tunnel to 2:00 minute transfers. This increases the flow rate demand at the flow splitter to about 59 GPM. At this point, you can simply change injectors, if needed, adjust the vacuum sensor, the power settings and/or oxygen flows to compensate. This flexibility becomes important when you consider that a plant may change their tunnel out for a longer model (i.e., extended size and larger capability loads) or a different brand.

Figure 5:
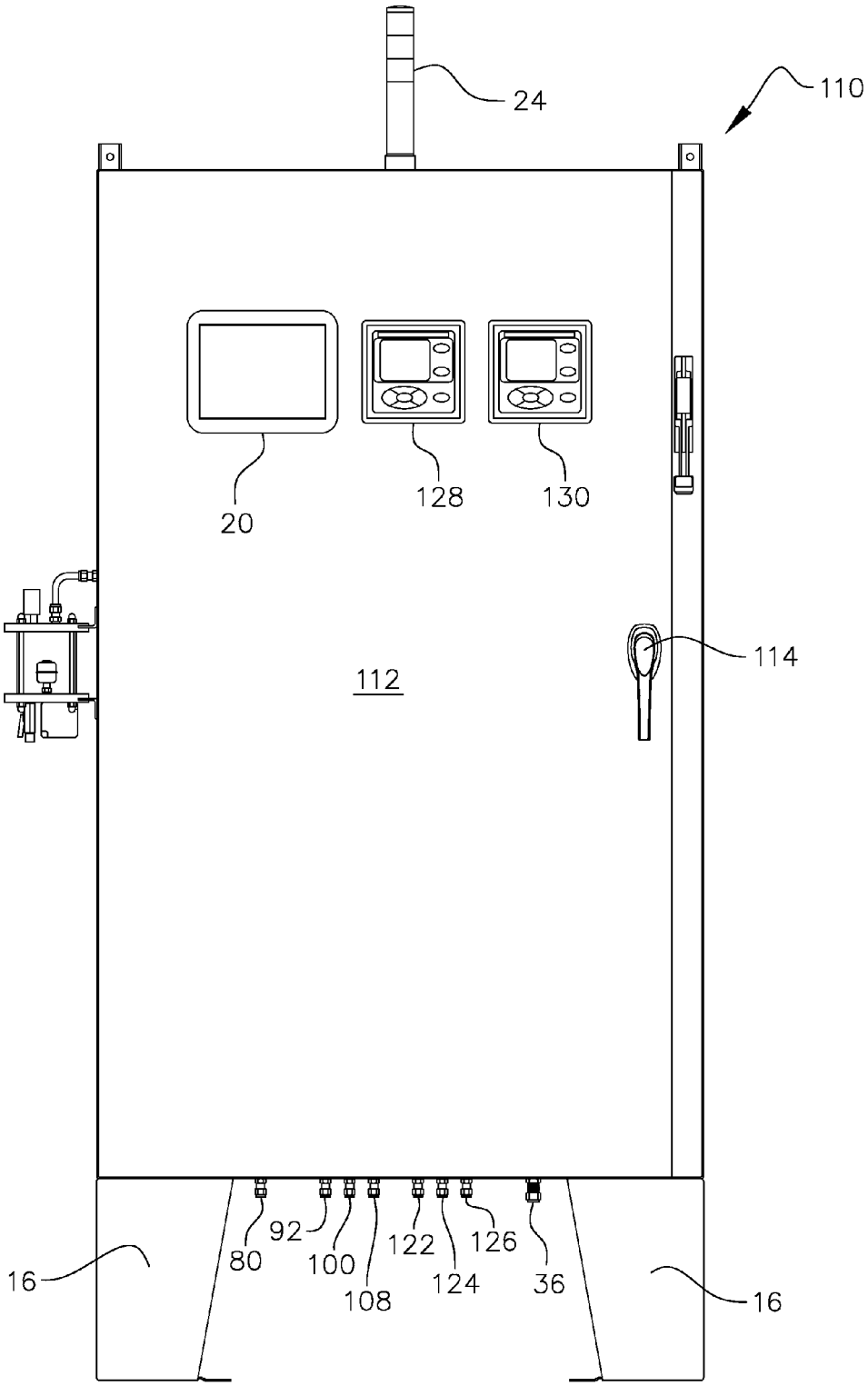
FIG. 5 is a front plan view of an alternate embodiment of the ozone laundry system of the present invention for use in larger capacity uses and wherein additional monitoring is desired.
Figure 6:
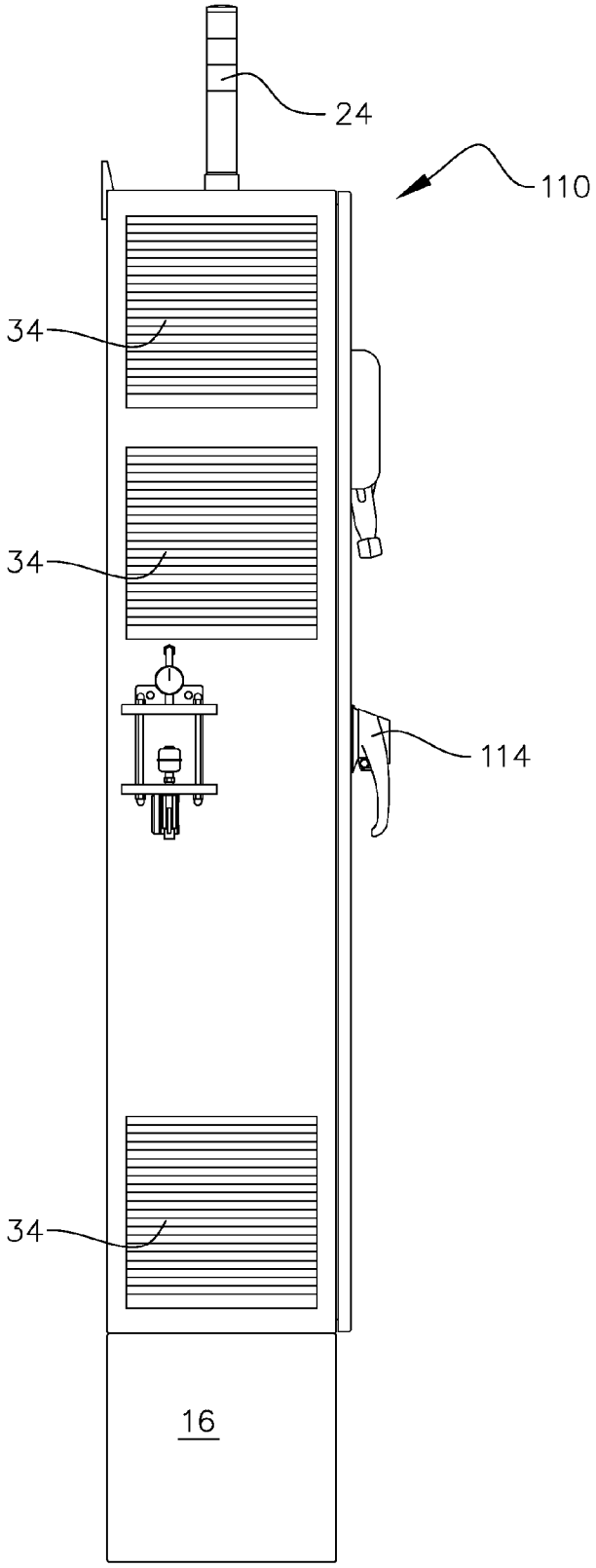
FIG. 6 is a left plan view of the alternate embodiment of the ozone laundry system of the present invention as seen in FIG. 5.
Figure 7:
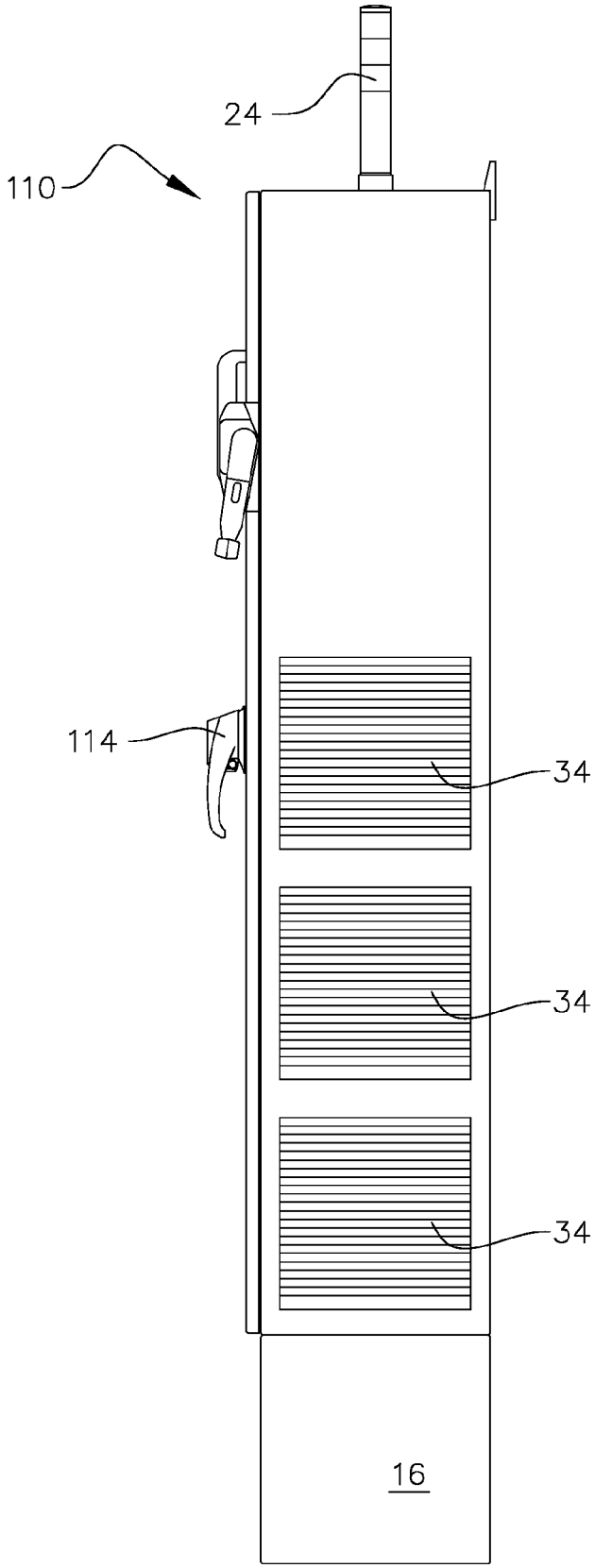
FIG. 7 is a right plan view of the alternate embodiment of the ozone laundry system of the present invention as seen in FIG. 5.

With reference now to FIGS. 5-7, an alternate embodiment of the ozone laundry system 110 of the present invention is shown. With reference first to FIG. 5, alternate ozone laundry system 110 is shown having a hinged door 112 and a handle 114. Referring to FIG. 6, a left side 116 is shown having three air vents 34 (although more or less could be employed) and the same backflow sensor 28 of the preferred ozone laundry system 10. Referring to FIG. 7, a right side 118 is shown having three air vents 34 (but again, more or less could be employed). Also, as seen in FIGS. 5-7, alternate ozone laundry system 110 has a light tree 24 just as preferred ozone laundry system 10 and works in the same manner and for the same purposes. Alternate ozone laundry system 110 also employs supports legs 16 just as again, preferred ozone laundry system 110.

In fact, alternate ozone laundry system 110 works in the same manner as ozone laundry system 10, but is configured as a larger capacity unit for treating more zones in a larger continuous batch or tunnel washer. If necessary, but not required, the oxygen concentrators can be placed in a second cabinet (see FIG. 8), positioned in close proximity of the cabinet enclosing alternate ozone laundry system 110. As shown in FIG. 5, additional compression fittings are shown protruding from a bottom portion 120. In addition to the first compression fitting 36 for connection to the system 110 from the plant location's compresses air source, there is the first ozone generator compression fitting 80 that is connected to the DOM. Then there are the second ozone generator first, second and third compression fittings 92, 100 and 108, respectively, which treat three zones of a continuous batch or tunnel washer. Thereafter, there are a set of additional compression fittings that include a third ozone generator (not shown) first, second and third compression fittings 122, 124 and 126 for treating three additional zones of a continuous batch or tunnel washer.

With continuing reference to FIG. 5, it is shown that there is an HMI 20, working in the same manner as with preferred ozone laundry system 10. However, in alternate ozone laundry system 110 there is a two channel metering function wherein a combined DOM/ORP 128 is provided along with a combined pH/ORP 130. This is used to measure ORP and pH. Accordingly, there is an ORP and a pH sensor installed in the press pan (or press reuse water line/flow) of the tunnel. The ORP will serve the same function as before. But, it now gives the operator the ability to see the final pH of the wash process for any give wash classification they want. This data is used for results verification at this point and can also integrate alarm functions, if so desired. The additional ORP probe on this system will be installed mid-process. This is again for verification of ozone presence. It is necessary in the present invention to know the baseline ORP of a tunnel under normal conditions in the chemistry and soiled areas of the system. With this information, the operator has a basis to the ozone in that part of the process. Other alternate embodiments can use the pH reading from this sensor to control a chemical pump that would be responsible for injecting the correct amount of neutralizing agent into the washer for a given wash classification. However, this requires additional hardware, programming parameters, and a connection to a tunnel output signal that would tell the ozone system what formula was being run.

Still further, another alternate embodiment of the ozone system could be employed chemical companies as an OEM product. Such is useful in ozone systems that interface with the chemical control systems that they already use. The dosing of pH neutralizer is just one example for this use. Using pH meters, ORP meters, conductivity sensors, and other components, the system can communicate wash conditions to the ozone systems HMI, and could allow for PLC outputs to a chemical pump system that specifically works with the ozone laundry system.

Still even further, the present ozone systems can be configured to be sold to tunnel washer manufacturers. An engineered solution of the present invention and a CBW manufacturer includes an interface between the ozone system and tunnel washer controls. An integrated system has the ability to vary the ozone output levels to the tunnel washer based on the classifications being washed.

Equivalent elements can be substituted for the ones set forth herein to achieve the same results in the same way and in the same manner.

Having thus described the present invention in the detailed description of the preferred embodiment, what is desired to be obtained in letters Patent is:

1. An ozone laundry system connected to a single continuous batch or tunnel washer, the single continuous batch or tunnel washer having a plurality of chambers and at least a mid-process point and an end process point, the ozone laundry system comprising:

at least one fully integrated cabinet enclosing a multiplicity of components that form the ozone laundry system connected to the single continuous batch or tunnel washer;

a series of compression fittings protruding from the at least one fully integrated cabinet and connected to a multiplicity of components that form the ozone laundry system, a first input compression fitting of the series of compression fittings connected to a compressed air input source and at least two output compression fittings of the series of compression fittings providing at least two output streams of generated ozone to the single continuous batch or tunnel washer;

at least one two-channel meter having a dissolved ozone monitor and an oxidation reduction potential monitor located on the at least one fully integrated cabinet, the dissolved ozone monitor taking its reading at least one of a plurality of water inlet locations of the single continuous batch or tunnel washer, and the oxidation reduction potential monitor taking its reading in at least one of the plurality of chambers of the single continuous batch or tunnel washer;

a human machine interface located on the at least one fully integrated cabinet; and a power source providing electrical energy to all of the multiplicity of components within the at least one fully integrated cabinet that form the ozone laundry system.

2. The ozone laundry system of claim 1, wherein the multiplicity of components that form the ozone laundry system includes at least one pressure regulator, a plurality of solenoids, a humidity removal device, at least one oxygen concentrator, at least one $O_2$ sensor, at least one flow meter, at least one ozone generator, a plurality of valves, at least one vacuum sensor and a programmable logic circuit.

3. The ozone laundry system of claim 2, wherein the at least one ozone generator supplies generated ozone to a first output compression fitting of the series of compression fittings which controls a level of dissolved ozone in the single continuous batch or tunnel washer and in addition supplies generated ozone to a set of three output compression fittings which supplies ozone into a fresh water stream in at least three different zones of the plurality of chambers of the single continuous batch or tunnel washer.

4. The ozone laundry system of claim 2, further comprising at least two oxygen concentrators, at least two ozone generators and a crossover network.

5. The ozone laundry system of claim 4, wherein a first ozone generator of the at least two ozone generators supplies generated ozone to a first output compression fitting of the series of compression fittings which controls a level of dissolved ozone in the single continuous batch or tunnel washer.

6. The ozone laundry system of claim 4, wherein a second ozone generator of the at least two ozone generators supplies generated ozone to a set of three output compression fittings which supplies ozone into a fresh water stream in the at least three different zones of the plurality chambers of the single continuous batch or tunnel washer.

7. The ozone laundry system of claim 2, wherein the humidity removal device is at least one coalescing filter having a filament material positioned there within.

8. The ozone laundry system of claim 2, wherein the vacuum sensor transmits vacuum/pressure levels to the programmable logic circuit interfacing with the human machine interface.

9. The ozone laundry system of claim 2, further comprising a plurality of variable programmed set points on different zones of the system for sensing vacuum/pressure levels.

10. The ozone laundry system of claim 1, wherein the at least one two-channel meter comprises a second two channel meter having a pH monitor and a second oxidation reduction potential monitor.

11. The ozone laundry system of claim 1, wherein the human machine interface is a touch-screen sensitive device.

12. The ozone laundry system of claim 1, wherein the system can be controlled locally, through an intranet or over the Internet by laptop, personal computer, tablet PC or a hand held computing device.

13. The ozone laundry system of claim 1, further comprising a plurality of programmable alarm functions.

14. The ozone laundry system of claim 1, wherein the at least one cabinet comprises a first and a second cabinet, the second cabinet housing at least one oxygen concentrator.

15. The ozone laundry system of claim 14, wherein the system can entrain ozone along a fresh water stream to at least six different zones of the plurality of chambers of the single continuous batch or tunnel washer.

16. The ozone laundry system of claim 1, wherein an oxidation reduction potential is measured at the mid-process point and at the end process point of the single continuous batch or tunnel washer by the oxidation reduction potential monitor.

17. An ozone laundry system connected to a single continuous batch or tunnel washer, the single continuous batch or tunnel washer having a plurality of chambers and at least a mid-process point and an end process point, the ozone laundry system comprising:

at least two fully integrated cabinets enclosing a multiplicity of components that form the ozone laundry system;

a series of compression fittings protruding from a first of the at least two cabinets and connected to the multiplicity of components that form the ozone laundry system providing a connection to a compressed air input source and at least two output streams of generated ozone to the single continuous batch or tunnel washer;

at least one two-channel meter having a dissolved ozone monitor and an oxidation reduction potential monitor located on one of the at least two fully integrated cabinets, the dissolved ozone monitor taking its reading at least one of a plurality of water inlet locations of the single continuous batch or tunnel washer and the oxidation reduction potential monitor taking its reading in at least one of the plurality of chambers of the single continuous batch or tunnel washer;

a human machine interface located on one of the at least two cabinets; and a power source providing electrical energy to all of the multiplicity of components within the at least two cabinets that form the ozone laundry system.

18. The ozone laundry system of claim 17, wherein the multiplicity of components that form the ozone laundry system includes at least one pressure regulator, a plurality of solenoids, a humidity removal device, at least one oxygen concentrator, at least one $O_2$ sensor, at least one flow meter, at least one ozone generator, a plurality of valves, at least one vacuum sensor and a programmable logic circuit.

19. The ozone laundry system of claim 17, wherein the at least one two-channel meter comprises a second two-channel meter having a pH monitor and a second oxidation reduction potential monitor.

20. The ozone laundry system of claim 17, further comprising:

at least two oxygen concentrators, at least two ozone generators, and a crossover network, wherein a first ozone generator of the at least two ozone generators supplies generated ozone to a first output compression fitting of the series of compression fittings and controlling a level of dissolved ozone in the single continuous batch or tunnel washer and wherein a second ozone generator of the at least two ozone generators supplies generated ozone to a set of three output compression fittings thereby supplying ozone into a fresh water stream in at least three different zones of the plurality of chambers of the single continuous batch or tunnel washer.

21. The ozone laundry system of claim 18, wherein the humidity removal device is at least one coalescing filter having a filament material positioned there within.

22. The ozone laundry system of claim 17, wherein an oxidation reduction potential is measured at the mid-process point and at the end process point of the single continuous batch or tunnel washer by the oxidation reduction potential monitor.

23. The ozone laundry system of claim 17, wherein the system entrains ozone along a fresh water stream to a multiplicity of different zones of the plurality of chambers of the single continuous batch or tunnel washer.

24. The ozone laundry system of claim 17, further comprising a plurality of variable programmed set points on different zones of the system for sensing vacuum/pressure levels.

25. An ozone laundry system comprising:

a single continuous batch or tunnel washer having a plurality of chambers;

at least one fully integrated cabinet enclosing a multiplicity of components that form the ozone laundry system connected to the single continuous batch or tunnel washer;

a series of compression fittings protruding from the at least one fully integrated cabinet and connecting an ozone generation system within the at least one fully integrated cabinet to the single continuous batch or tunnel washer;

at least one two-channel meter having a dissolved ozone monitor and an oxidation reduction potential monitor, located on the at least one fully integrated cabinet, the dissolved ozone monitor taking its reading at least one of a plurality of water inlet locations of the single continuous batch or tunnel washer, and the oxidation reduction potential monitor taking its reading in at least one of the plurality of chambers of the single continuous batch or tunnel washer;

a human machine interface located on the at least one fully integrated cabinet; and a power source providing electrical energy to the ozone generation system within the at least one fully integrated cabinet.

* * * * *